US005759135A

United States Patent [19]

Chen

[11] Patent Number: 5,759,135

[45] Date of Patent: Jun. 2, 1998

[54] STATIONARY EXERCISER

[76] Inventor: Paul Chen, 5F., No. 31, Gan Tzou 2nd Street, Shi Tun Chu, Taichung, Taiwan

[21] Appl. No.: 865,558

[22] Filed: May 29, 1997

[51] Int. Cl.[6] ..... A63B 21/00; A63B 69/16

[52] U.S. Cl. ..... 482/57; 482/70

[58] Field of Search ..... 482/51, 52, 53, 482/57, 70, 71, 72, 60, 79, 80, 63

[56] References Cited

U.S. PATENT DOCUMENTS

| | | | |
|---|---|---|---|
| 5,352,169 | 10/1994 | Eschenbach | 482/57 |
| 5,383,829 | 1/1995 | Miller | 482/57 |
| 5,423,729 | 6/1995 | Eschenbach | 482/57 |
| 5,520,596 | 5/1996 | Johnston | 482/51 |
| 5,529,555 | 6/1996 | Rodgers | 482/57 |
| 5,573,481 | 11/1996 | Piercy et al. | 482/63 |
| 5,685,804 | 11/1997 | Whan-Tong et al. | 482/57 |

*Primary Examiner*—Stephen R. Crow

[57] ABSTRACT

An exerciser includes a base and a crank rotatably secured to the base and having two arms. A pair of tubes have a front portion rotatably secured to the free ends of the arms. A pair of levers are pivotally coupled to the rear portion of the base and slidably engaged in the tubes for allowing the tubes to move forward and rearward relative to the levers and for allowing the tubes to be moved upward and downward when the crank is rotated. A resistance may be applied to the crank or the tubes for resisting the exercises of the user.

5 Claims, 2 Drawing Sheets

STATIONARY EXERCISER

BACKGROUND OF THE INVENTION

1. Field of the Invention

The present invention relates to an exerciser, and more particularly to a stationary exerciser for allowing the user to simulate walking and running exercises.

2. Description of the Prior Art

Typical stationary exercisers comprise a pair of foot pedals each having one or more wheels rotatably or slidably engaged with one or more tracks for allowing the foot pedals to move both upward and downward and forward and backward movements. U.S. Pat. Nos. 5,352,169 to Eschenbach and 5,383,829 to Miller disclose this type of stationary exercisers. However, the wheels may be disengaged from the tracks inadvertently. In addition, objects or user or children may be hurt by the wheels.

The present invention has arisen to mitigate and/or obviate the afore-described disadvantages of the conventional exercisers.

SUMMARY OF THE INVENTION

The primary objective of the present invention is to provide a stationary exerciser including a pair of foot supports that may be moved upward and downward and forward and rearward without engagement of wheels with tracks.

In accordance with one aspect of the invention, there is provided an exerciser comprising a base including a rear axle and a middle axle, a pair of levers including a rear portion pivotally coupled to the rear axle for allowing the levers to be rotated about the rear axle, a pair of arms secured to the middle axle and perpendicular to the middle axle and extended toward opposite directions for forming a crank, the arms each including a free end portion having a shaft, and a pair of tubes provided for supporting feet of a user, the tubes including a front portion rotatably secured to the shafts of the arms for allowing the tubes to be rotated about the shafts respectively, the levers being slidably engaged in the tubes for allowing the tubes to move forward and rearward relative to the levers and for allowing the tubes to be moved upward and downward when the arms are rotated about the middle axle.

A resistance applying means may apply a resistance force against a rotational movement of the arms about the middle axle and may applying a resistance force against the tubes.

The base includes a front axle, the resistance force applying means includes a wheel rotatably secured to the front axle, and means for coupling the wheel to the middle axle and for allowing the wheel to apply the resistance force against the arms and the tubes.

The coupling means includes two pulleys secured on the middle axle and the front axle respectively, and includes a belt engaged with the pulleys for coupling the pulleys together and for coupling the wheel to the middle axle.

The base includes a front portion having a post extended upward, and includes a handle secured on top of the post for supporting an upper portion of the user.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
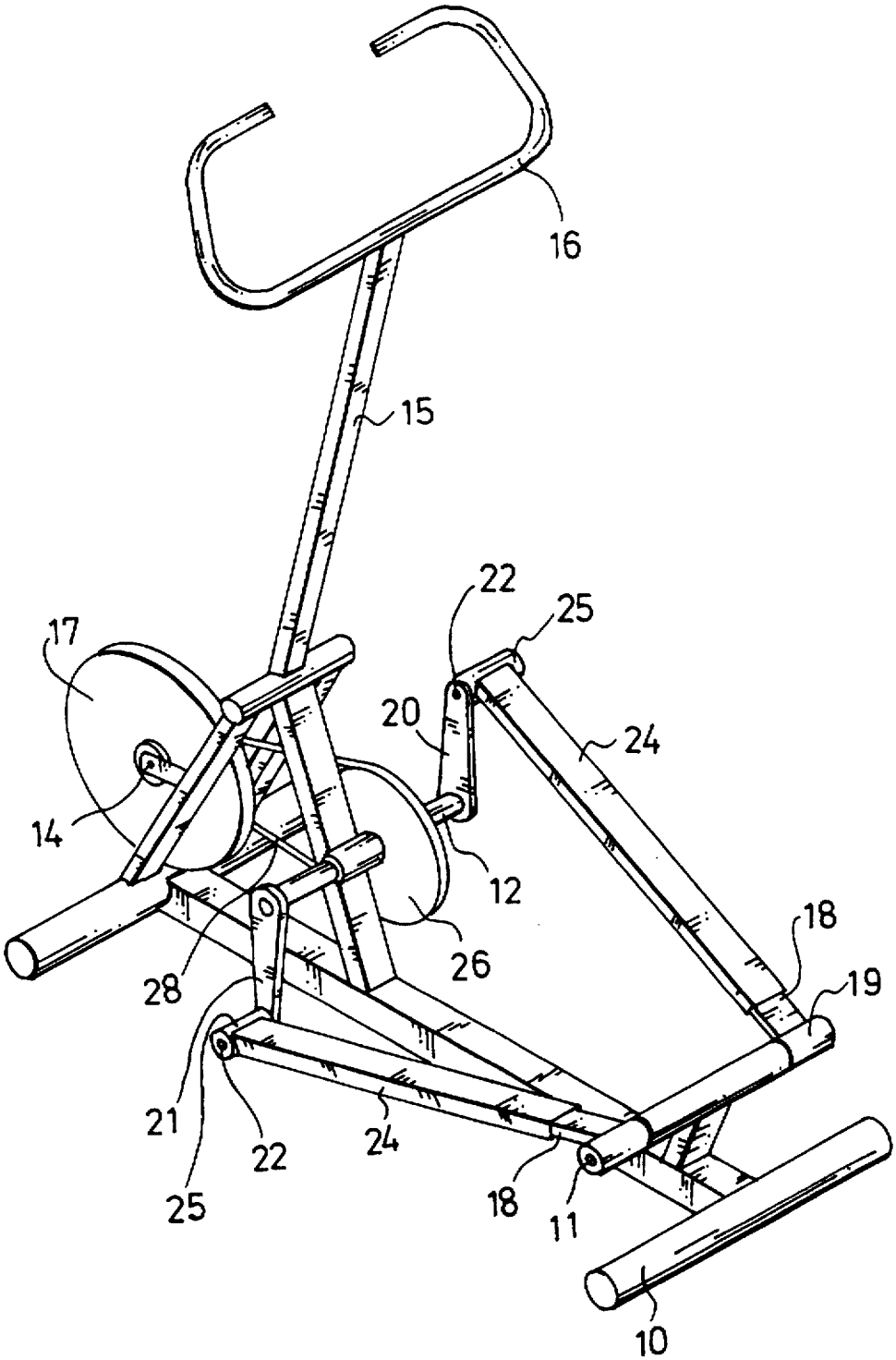
FIG. 1 is a perspective view of a stationary exerciser in accordance with the present invention.
Figure 2:
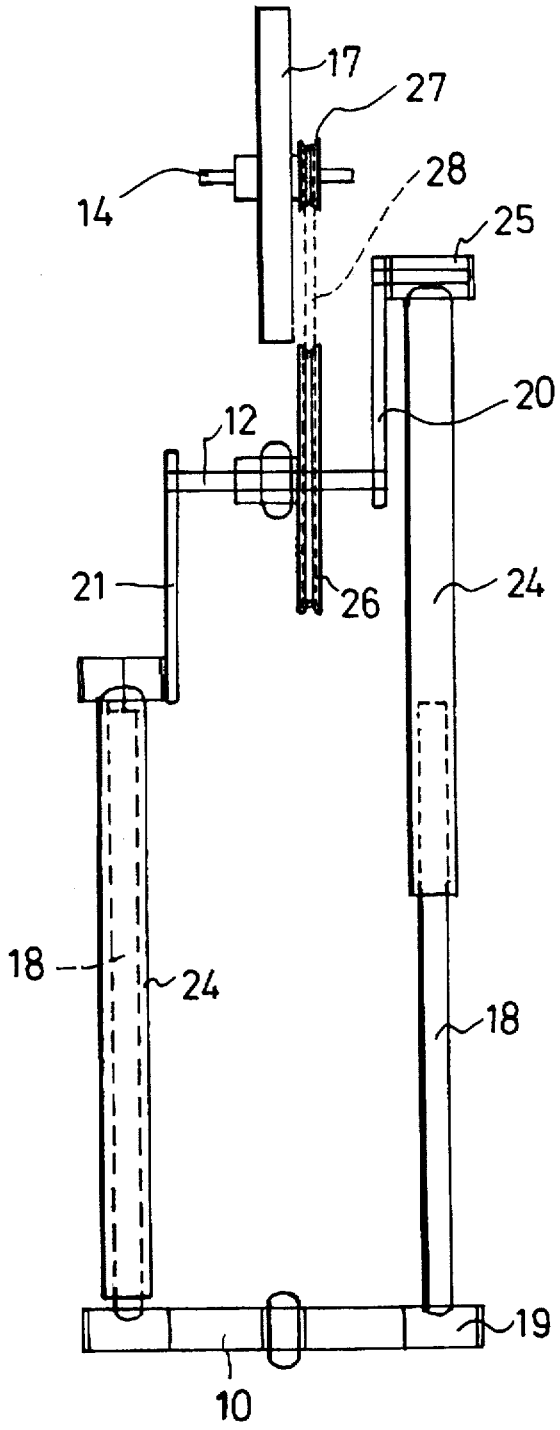
FIG. 2 is a top view of the exerciser.

Referring to the drawings, a stationary exerciser in accordance with the present invention comprises a base 10 including a rear axle 11, a middle axle 12 and a front axle 14, and including a post 15 extended upward from the front portion for supporting a handle 16 which may be used for supporting the upper portion of the user. A pair of levers 18 include a rear portion 19 rotatably secured to the rear axle 11 for allowing the levers 18 to be rotated about the rear axle 11 respectively. A pair of arms 20, 21 are secured to the ends of the middle axle 12 and extended toward the opposite directions so as to form a crank. The arms 20, 21 each includes a free end portion having a shaft 22. A pair of tubes 24 are provided for supporting the feet of the user and include a front portion 25 rotatably secured to the shafts 22 for allowing the tubes 24 to be rotated about the shafts 22 and about the middle axle 12 respectively. The levers 18 are slidably engaged in the tubes 24 respectively for allowing the tubes 24 to move forward and rearward relative to the levers 18.

A wheel 17 is rotatably secured to the front axle 14. Two pulleys 26, 27 are secured to the middle axle 12 and the front axle 14 respectively and are coupled together by a belt 28, such that the rotational movement of the middle axle 12 and the arms 20, 21 may cause the wheel 17 to rotate. The wheel 17 is preferably a paddle wheel for providing a suitable resistance to the rotational movement of the middle axle 12 and for resisting the movement of the tubes 24. The pulleys 26, 27 and the belt 28 may be replaced by sprockets and chain or be replaced by gears, for allowing the wheel 17 to provide a resistance to the movement of the tubes 24.

Accordingly, the exerciser in accordance with the present invention includes a pair of tubes or foot supports that may be moved upward and downward and forward and rearward without engagement of wheels with tracks.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a rear axle and a middle axle, a pair of levers including a rear portion pivotally coupled to said rear axle for allowing said levers to be rotated about said rear axle, a pair of arms secured to said middle axle and perpendicular to said middle axle and extended toward opposite directions for forming a crank, said arms each including a free end portion having a shaft, and a pair of tubes provided for supporting feet of a user, said tubes including a front portion rotatably secured to said shafts of said arms for allowing said tubes to be rotated about said shafts respectively, said levers being slidably engaged in said tubes for allowing said tubes to move forward and rearward relative to said levers and for allowing said tubes to be moved upward and downward when said arms are rotated about said middle axle.

2. An exerciser according to claim 1 further comprising means for applying a resistance force against a rotational movement of said arms about said middle axle and for applying a resistance force against said tubes.

3. An exerciser according to claim 2, wherein said base includes a front axle, said resistance force applying means includes a wheel rotatably secured to said front axle, and means for coupling said wheel to said middle axle and for allowing said wheel to apply the resistance force against said arms and said tubes.

4. An exerciser according to claim 3, wherein said coupling means includes two pulleys secured on said middle axle and said front axle respectively, and includes a belt engaged with said pulleys for coupling said pulleys together and for coupling said wheel to said middle axle.

5. An exerciser according to claim 1, wherein said base includes a front portion having a post extended upward, and includes a handle secured on top of said post for supporting an upper portion of the user.

* * * * *